US005439046A

United States Patent [19]

Miyazawa et al.

[11] Patent Number: 5,439,046

[45] Date of Patent: Aug. 8, 1995

[54] PROCESS FOR PRODUCING THIN SHEET BY CONTINUOUS CASTING IN TWIN-ROLL SYSTEM

[75] Inventors: Kenichi Miyazawa, Kimitsu; Takehiko Toh, Futtsu; Toshiaki Mizoguchi, Futtsu; Yoshiyuki Ueshima, Futtsu, all of Japan

[73] Assignee: Nippon Steel Corporation, Tokyo, Japan

[21] Appl. No.: 107,693

[22] PCT Filed: Dec. 18, 1992

[86] PCT No.: PCT/JP92/01668

§ 371 Date: Aug. 18, 1993

§ 102(e) Date: Aug. 18, 1993

[87] PCT Pub. No.: WO93/11893

PCT Pub. Date: Jun. 24, 1993

[30] Foreign Application Priority Data

Dec. 19, 1991 [JP] Japan ..... 3-337147

[51] Int. Cl.[6] ..... B22D 27/02; B22D 11/06

[52] U.S. Cl. ..... 164/467; 164/480; 164/428; 164/503

[58] Field of Search ..... 164/428, 480, 467, 503

[56] References Cited

FOREIGN PATENT DOCUMENTS 62-104653 5/1987 Japan .
63-80945 4/1988 Japan .
3-5048 1/1991 Japan .
3-35851 2/1991 Japan .

*Primary Examiner*—Kuang Y. Lin
*Attorney, Agent, or Firm*—Kenyon & Kenyon

[57] ABSTRACT

In a continuous casting process in a twin-roll system, a gap is provided between end faces of cooling rolls and side gates or between the circumferential surface of the cooling rolls and side faces of the side gates. A DC magnetic field is applied to the molten metal in a pouring basin in the vicinity of the side gates in a vertical direction to the molten metal and direct current (DC) is intensively fed to the end portion of the molten metal to generate an electromagnetic force mainly at a corner portion of the molten metal. The electromagnetic force is directed toward the center portion of the molten metal, and thereby prevents leakage of molten metal from the gap, penetration into the gap or the formation of hot bands. In order to intensively feed the direct current to the end portion of the molten metal, an electrode is placed in sliding contact with the end face of the cooling roll. Moreover, a good electrical conductor may be provided on an insulating portion provided on the end face of the cooling roll, or a good electric conductor may be embedded in the side gates.

16 Claims, 12 Drawing Sheets

PRIOR ART

O: END PORTION HAVING GOOD SHAPE
X: HOT BAND OCCURRED
Δ: CAST FIN AND DRIPPING OF MOLTEN METAL OCCURRED
HOT BAND OCCURRED
NONE
OCCURRED
NONE
CAST FIN AND DRIPPING OF MOLTEN METAL OCCURRED
OCCURRED
REGION CAPABLE OF PROVIDING GOOD SHAPE OF END PORTION IN CAST STRIP
0
0.4
0.8
1.2
1.6
2
GAP BETWEEN END FACE OF COOLING ROLL AND SURFACE OF SIDE GATE (mm)

PROCESS FOR PRODUCING THIN SHEET BY CONTINUOUS CASTING IN TWIN-ROLL SYSTEM

TECHNICAL FIELD

The present invention relates to a technique for continuously casting a thin cast strip, having a sheet thickness close to the thickness of a final product, by the so-called "synchronous continuous casting. process", that produces no difference in the relative velocity between the cast strip and an inner wall of a mold. The present invention especially relates to such a technique used in a twin-roll continuous casting process, and particularly to a technique for preventing molten metal from leaking out from a pouring basin formed between the upper portion of two rolls.

BACKGROUND ART

In recent years, in the field of continuous casting of metals, various proposals have been made regarding a technique, for casting a thin cast strip having a thickness (2 to 10 mm) close to the thickness of a final product produced by a continuous casting apparatus, using cooling rolls provided with cooling mechanisms inside thereof so as to reduce the production costs, create novel materials, etc.

In the above-described casting technique, the so-called "twin-roll continuous casting process", already known in the art, comprises placing a pair of cooling rolls, rotatable respectively in opposite directions, so as to face each other in parallel while providing a suitable gap therebetween, pressing two side gates against both end faces of the cooling rolls to form a pouring basin for a molten metal above the gap, and continuously casting a thin sheet through the gap, while cooling the molten metal in the pouring basin and rotating the outer periphery of the cooling rolls.

Japanese Unexamined Patent Publication (Kokai) Nos. 60-166149, 63-180348 and 63-183750 and the like disclose a variable width strip casting technique (the twin-roll system) in which casting is effected with the width of a cast strip being arbitrarily varied. Specifically, in a continuous casting machine described in Japanese Unexamined Patent Publication (Kokai) NO. 60-166149, a rotary cooling drum is shifted in the axial direction thereof, and a shield plate fitted onto the surface of the drum is pressed with a spring against the side face of the other drum to form a pouring basin, thereby allowing the width of the cast strip to be varied. Japanese Unexamined Patent Publication (Kokai) No. 63-180348 discloses a casting method wherein casting is effected while vibrating, in the direction of the circumferential direction of the cooling rolls, a side gate provided in contact with the side face of a first cooling roll shifted towards the axial direction of the cooling roll and the circumferential surface of the other cooling roll. Japanese Unexamined Patent Publication (Kokai) No. 63-183750 discloses a side gate which has a tapered end portion to abut against the circumferential surface of the cooling drum to prevent the molten metal from penetrating into the gap between the cooling drum and the side gate.

However, it is difficult to prevent the molten metal from penetrating into the gap between the end face of the cooling roll and the side weir or the gap between circumferential surface of the cooing roll and the side weir (i.e., penetration of molten metal) even by mechanical pressing of the side weir against the cooling roll in one direction or application of vibration to the side weir as in the above-described techniques, which cause the molten metal to penetrate into the above-described gap to form a cast fin on the cast strip. This fin unfavorably shaves the refractory material of the side gate, which causes leakage of the molten metal.

In order to prevent the leakage of the molten metal, Japanese Unexamined Patent Publication (Kokai) No. 62-104653 discloses a technique where an electrode slides on the surface (circumferential surface) of energizable cooling rolls in a twin-roll system to feed DC (direct current) to a molten metal present in the gap between the cooling rolls. Also a DC magnetic flux acts on the molten metal in a direction normal and opposite to the direction of the above-described DC current by means of a DC magnetic flux generator provided in the vicinity of the end portion of each cooling roll to apply electromagnetic force from the end portion of the cooling roll towards the inside of the roll in the axial direction of the roll, thereby holding the molten metal about to leak out from the end portion of the cooling roll and to regulate the shape of the end face of the molten metal.

On the other hand, Japanese Unexamined Patent Publication (Kokai) No. 62-77154 discloses a technique where an electrode for energizing a molten metal is provided on a supporting shaft of cooling rolls in a twin-roll system to feed current to a molten metal. According to the technique an energizing plate (a side dam) is provided on both outer ends (end faces) of the cooling roll so as to block the molten metal and to feed current to the molten metal in a direction opposite to the direction of the above-described current, thereby generating electromagnetic repulsive force in the molten metal in the vicinity of the energizing plate to prevent the molten metal from leaking out from the side face of the roll.

Further, Japanese Unexamined Patent Publication (Kokai) No. 63-97341 discloses a technique where magnets are provided on the side end face of cooling rolls in a twin-roll system to form magnetic fields which repel each other in the direction of the magnetic lines of force with DC being allowed to flow between an electrode provided in a ladle and a contact provided on a cast metallic sheet, thereby giving rise to an electromagnetic force which holds the molten metal between the cooling rolls.

In the above-described techniques, where electromagnetic force is induced to prevent the leakage of the molten metal, since DC is applied to the whole molten metal, when the space in the horizontal direction between the cooling rolls is large, it becomes difficult for an ordinary electromagnetic force, generated by current and magnetic field strength, to hold the molten metal which in turn makes it difficult to prevent the leakage of the molten metal.

Further, when the molten metal has a height of, for example, 50 mm or more, since the electromagnetic force provided by the above-described methods cannot completely stop vibration caused in a pouring basin portion, the vibration causes the end portion of the resultant cast strip to become wavy, so that the end portion of the cast strip must be cut off in a later step, which reduces the efficiency of the casting machine and the yield of the cast strip.

DISCLOSURE OF INVENTION

An object of the present invention is to solve the above-described problems and to provide means which can very effectively prevent the occurrence of a cast fin at the end portion of a cast strip, leakage of molten metal from a gap in the pouring basin, and vibration of the molten metal.

Another object of the present invention is to provide means which allows casting of a thin sheet to be smoothly effected with minimized deposition of metal (a shell) on the side gates, without application of heat or forced vibration of the side gates.

In order to attain the above-described objects, the present invention provides the following process and apparatus for casting a thin sheet.

Specifically, the present invention is characterized in that, in a continuous casting apparatus in a twin-roll system, gaps are provided between end faces of cooling rolls and a pair of side gates in their respective faces confronting each other to allow the corner portion of molten metal to cool. A DC magnetic field is applied to the molten metal in the vicinity of the side gates, in a pouring basin, in a direction vertical to the molten metal. Also, at the same time, an electrode for feeding current is brought into sliding contact with the end faces of the cooling rolls to allow DC to intensively flow into the molten metal in the vicinity of the side gates, thereby causing electromagnetic force to be intensively generated in the molten metal in the vicinity of the side gates by the DC magnetic field and the DC, thus allowing casting to be effected while preventing the molten metal from leaking out from the corner portion of the molten metal.

The location on the cooling roll where the electrode for feeding DC is brought into slide contact is very important to the present invention.

In general, in the case of DC, the product of the current and the electrical resistance equals the voltage across the electrodes. When current flows through a material having a homogeneous electrical resistance, since the electrical resistance increases in accordance with an increase in the distance which the current flows, the current value decreases when the distance is increased. Therefore, when the DC from the positive electrode flows through a location having a low electrical resistance or a short distance, the current value is high, while when it flows through a place having a high electrical resistance or a long distance, the current value is low.

As described in Japanese Unexamined Patent Publication (Kokai) No. 62-104653, when an electrode is brought into sliding contact with the lower portion of the circumferential surface of a pair of cooling rolls, since the current flows also in the axial direction of the rolls, the distributed current flows into the molten metal in the vicinity of the side gates, so that the electromagnetic force generated is so small that it not only becomes difficult to prevent the molten metal from penetrating into the gap between the side gate and the roll, but also grinding abrasion of the roll surface unfavorably occurs at its portion in sliding contact.

In contrast, the sliding contact of an electrode with the end face of the cooling rolls causes the current to flow through the molten metal in the vicinity of the side gates, which contributes to a remarkable increase in the electromagnetic force that acts on the molten metal.

Further, in the present invention, a good electrical conductor is provided on an insulator, which is covered on the end face of the cooling rolls, for the purpose of allowing a large amount of current to flow into the molten metal in the vicinity of the side gates. Specifically, since sliding contact of the electrode with the surface of the good electrical conductor causes the current to flow only through the good electric conductor and not into the body of the cooling rolls, when the current flows into the molten metal, electromagnetic force is intensively generated in the vicinity of the side gates.

When a good electric conductor is integrated into the side gates according to another embodiment of the present invention, since a gap is provided between the end face of the cooling rolls and the side gates, the end face of the cooling roll and the good electric conductor confront each other at a very short distance, with the corner portion of the molten metal being sandwiched therebetween, which causes the electrical resistance of this circuit to become low so that the value of current flowing into the corner portion of the molten metal becomes larger, thus allowing the maximium electromagnetic force to be generated.

Thus, according to the present invention, since the electromagnetic force is intensively generated in the vicinity of the corner portion of the molten metal, the present invention can offer the advantages that the leakage of the molten metal from the space between the side gate and the end portion of the cooling roll can be prevented, that a cast fin is not formed, that dripping of the molten metal does not occur, and that the occurrence of a hot band can be prevented because the corner portion of the molten metal is air-cooled by virtue of the presence of the above-described gap.

The same effect of intensively generating electromagnetic force can be attained by practicing the present invention also when casting is effected using a variable strip width casting apparatus wherein a pair of cooling rolls are disposed in such a state that they are shifted in the axial direction thereof.

BRIEF DESCRIPTION OF THE DRAWINGS

FIGS. 1(A) and (B) are diagrams showing an embodiment of the present invention, wherein FIG. 1(A) is a plan view and FIG. 1(B) is a left side view of FIG. 1(A);

FIGS. 3(A) and (B) shows the positional relationship between the end face of the cooling roll and the side gate, wherein FIG. 3(A) is an embodiment of the prior art and FIG. 3(B) is an embodiment of the present invention;

FIGS. 6(A) and (B) are diagrams showing a further embodiment of the present invention, wherein FIG. 6(A) is a plan view and FIG. 6(B) is a left side view of FIG. 6(A);

BEST MODE FOR CARRYING OUT THE INVENTION

The present invention will now be described with reference to the accompanying drawings.

Figure 1A:
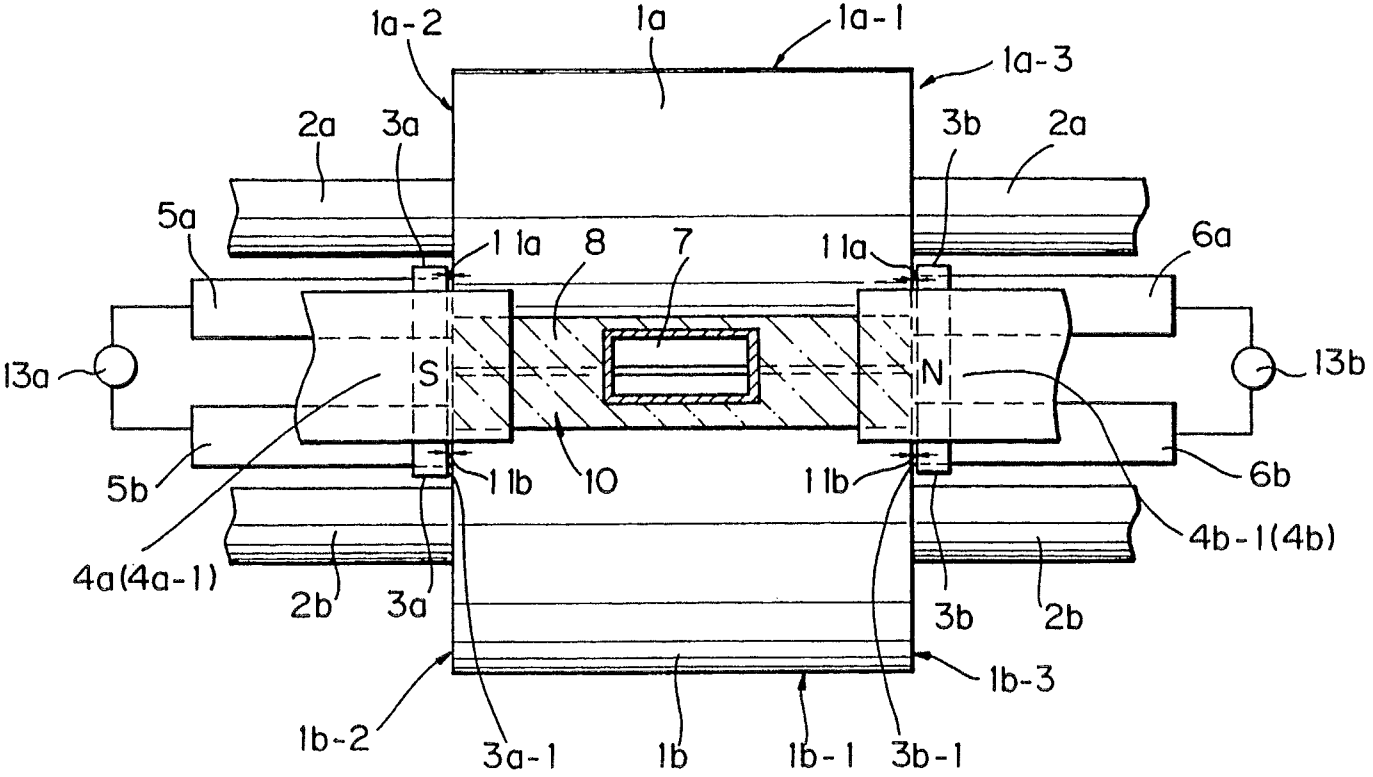

FIGS. 1(A) and (B) are a schematic view of a twin-roll casting apparatus according to the present invention. This apparatus comprises rotatable cooling rolls 1*a*, 1*b* having shafts 2*a*, 2*b* provided parallel to each other, side gates 3*a*, 3*b* respectively provided so as to confront cooling rolls 1*a*, 1*b*, and an nozzle 7 for pouring molten metal 8 into a pouring basin portion 10. In the casting of a thin sheet, the cooling rolls 1*a*, 1*b* are rotated respectively in directions A, A opposite to each other to cool and solidify the molten metal and, at the same time, to press-contact a solidified shell at the kissing point (the nearest approach point between circumferential surfaces 1*a*-1, 1*b*-1 of the cooling rolls), thereby continuously providing a thin sheet 9.

In the above-described apparatus, according to the present invention, at the outset, gaps 11*a*, 11*b* are provided between the end faces 1*a*-2, 1*b*-2 of the cooling rolls and the faces 3*a*-1, 3*b*-1 confront each other in the side gates 3*a*, 3*b*.

These gaps are provided particularly for the purpose of preventing the occurrence of a hot band caused during casting. This will now be described with reference to FIGS. 3(A) and (B).

Figure 3B:
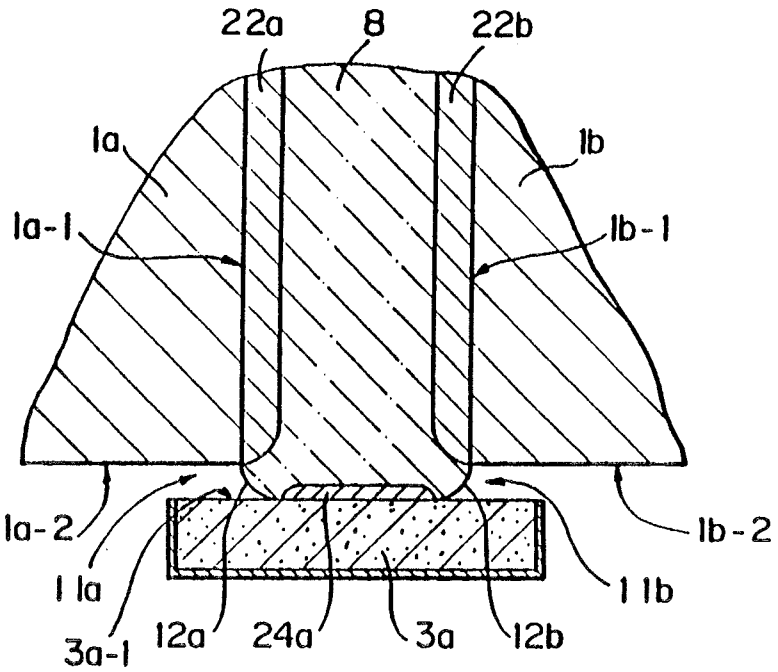
Figure 3A:
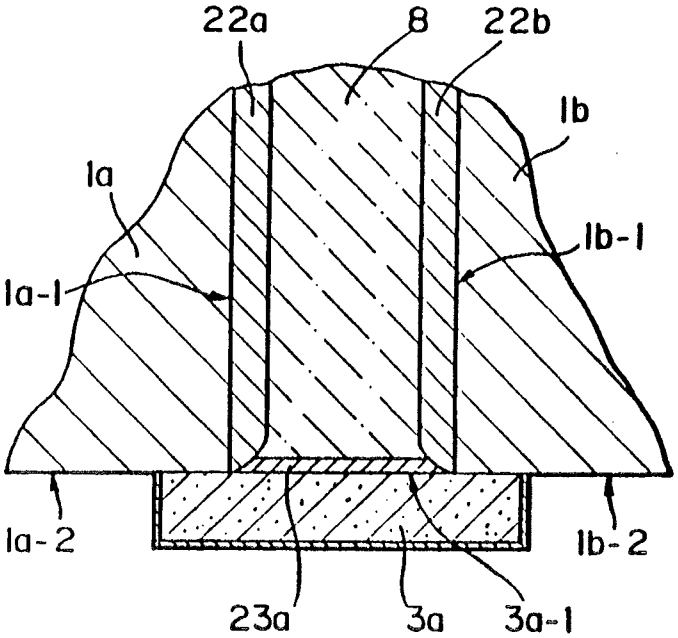

As shown in FIG. 3(A), when the end faces 1*a*-2, 1*b*-2 of the cooling rolls are in contact with the face 3*a*-1 of the side gate confronting them, solidified shells 22*a*, 22*b* are formed on the circumferential surfaces 1*a*-1, 1*b*-1 of the cooling rolls and, in many cases, a solidified shell 23*a* is formed also on the side gate 3*a* (particularly when neither preheat nor forced vibration is applied).

The solidified shells 22*a*, 22*b* move downward at the same speed as that of the rotation of the cooling rolls. At that time, they combine with the solidified shell 23*a* formed on the side weir and the resultant combination moves downward. When these solidified shells are passed through the kissing point, they widen the gap between the cooling rolls to form a cast strip having a locally increased thickness, i.e., a hot band.

Besides the problem of a locally increased thickness in the cast strip, this hot band gives rise to the following problem. Since the solidification and cooling rates are lower than those in the sound portion, the cast strip easily breaks during the conveyance and winding of the cast strip, which hinders stable production of a cast strip in thin sheet form. It is difficult to completely prevent the formation of hot bands even when preheat or forced vibration of the side gate is applied for the purpose preventing the formation of hot bands.

Further, production of a cast fin or dripping of the molten metal are liable to occur due to leakage of the molten metal from the gap between the end face of the cooling roll and the side gate in contact with it. When the side gate is strongly pressed against the end face of the cooling roll for the purpose of preventing this unfavorable phenomenon, although the occurrence of the cast fin or the like can be prevented, grinding abrasion occurs in the side gate, which gives rise to a problem of maintenance of the apparatus.

On the other hand, as shown in FIG. 3(B), when the side gate 3*a* is disposed with a small space being provided between the side gate 3*a* and the end faces 1*a*-2 and 1*b*-2 of the cooling rolls, since the corner portions 12*a*, 12*b* of the molten metal in the gaps 11*a*, 11*b* are not allowed to cool, no solidified shell is formed, which causes the width of the solidified shell 24*a* formed on the side of the side gates to become so small that the solidified shell 24*a* does not combine with the solidified shells 22*a*, 22*b*, thus preventing the formation of a hot band. Specifically, when the solidified shell on the side of the cooling rolls does not combine with the solidified shell on the side of the side gates until the molten metal reaches the meniscus portion or middle portion of the pouring basin portion, since the flow rate of the molten metal becomes great at the lower portion of the pouring basin portion (i.e. in the vicinity of the kissing point) the formation of the solidified shell in the side gates is inhibited, so that there is no possibility that both the solidified shells combine with each other, which results in avoidance of the formation of a hot band.

However, when the side gate is disposed with a space being provided between the side gate and the end face of the cooling rolls, the penetration of the molten metal into the gap, and further the leakage of the molten metal, unfavorably occurs.

Thus, in the present invention, electromagnetic force is produced to intensively act mainly on a portion in the vicinity of the side gates, particularly on the corner portion of the molten metal present in the above-described gap, to hold the molten metal in its corner portion, thereby simultaneously preventing the formation of a hot band, casting defects such as cast fins, and the leakage of the molten metal.

The means for allowing the electromagnetic force to intensively act on the molten metal in the vicinity of the side gates will now be described.

In a twin-roll casting apparatus shown in FIGS. 1(A) and (B), magnetic poles 4*a*, 4*a*-1, 4*b*, 4*b*-1 for feeding a DC magnetic field are provided above and below side gates 3*a*, 3*b*, and electrodes 5*a*, 5*b*, 6*a*, 6*b* for feeding DC are brought into sliding contact with end faces 1*a*-2 and 1*b*-2 of cooling rolls 1*a*, 1*b*. Numerals 13*a*, 13*b* each designate a DC power source.

In the above-described apparatus, during casting, an upward DC field directed to the magnetic pole 4*a* (S pole) from the magnetic pole 4*a*-1 (N pole) and a downward DC magnetic field directed to the magnetic field 4*b* (S pole) from the magnetic pole 4*b*-1 (N pole) are applied. Further, the electrodes 5*a*, 5*b*, 6*a* and 6*b* are brought into contact with the end faces 1*a*-2 and 1*b*-2 of the cooling rolls being rotated in the directions A, A to feed DC.

Figure 2:
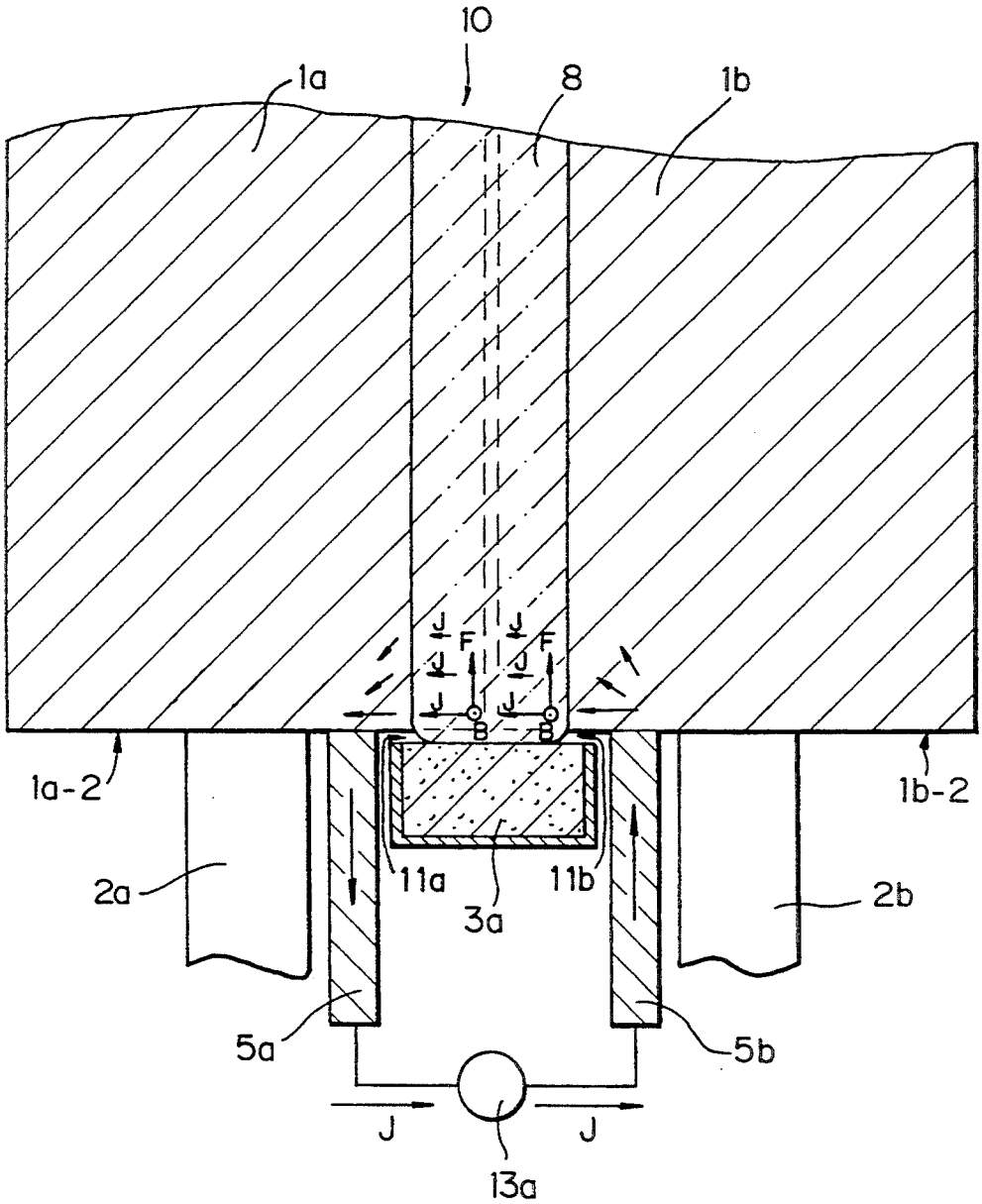
FIG. 2 is a cross-sectional view taken along line II—II of FIG. 1(B)

FIG. 2 is a diagram showing the flow of current and the state of generation of electromagnetic force on the side of the end face of the cooling rolls in contact with the electrodes 5*a*, 5*b*. In the drawing, DC current J leaving the DC power source 13*a* flows from the electrode 5*b* through the end face of the cooling roll 1*b*-2 into the cooling roll 1*b*. Most of the DC current J flows in the vicinity of the end face 1*b*-2 of the cooling roll, passes through the molten metal 8 and the cooling roll 1*a* and is then directed to the electrode 5*a*. Thus, when the DC current J is applied, the electromagnetic force F directed to the center of the cooling roll along the axial direction of the cooling roll acts on the molten metal mainly in the vicinity of the side gate 3*a* by virtue of the function of magnetic field B in the DC magnetic field according to Fleming's left-hand rule.

When the magnetic poles 4a and 4a-1 are north and south poles, respectively, if DC is fed from the electrode 5a towards the electrode 5b, an electromagnetic force directed to the center of the width of the cooling roll acts on the molten metal in the vicinity of the side gate 3a according to Fleming's left-hand rule. Therefore, even when the direction of the DC magnetic field is reversed, the electromagnetic force can be directed to the center, in the width direction, of the roll by regulating the direction of DC according to Fleming's left-hand rule.

Also with respect to the molten metal on the side of the end face of the cooling roll in contact with the electrodes 6a, 6b, electromagnetic force acts on the molten metal under the same principle as that described above.

Figure 4:
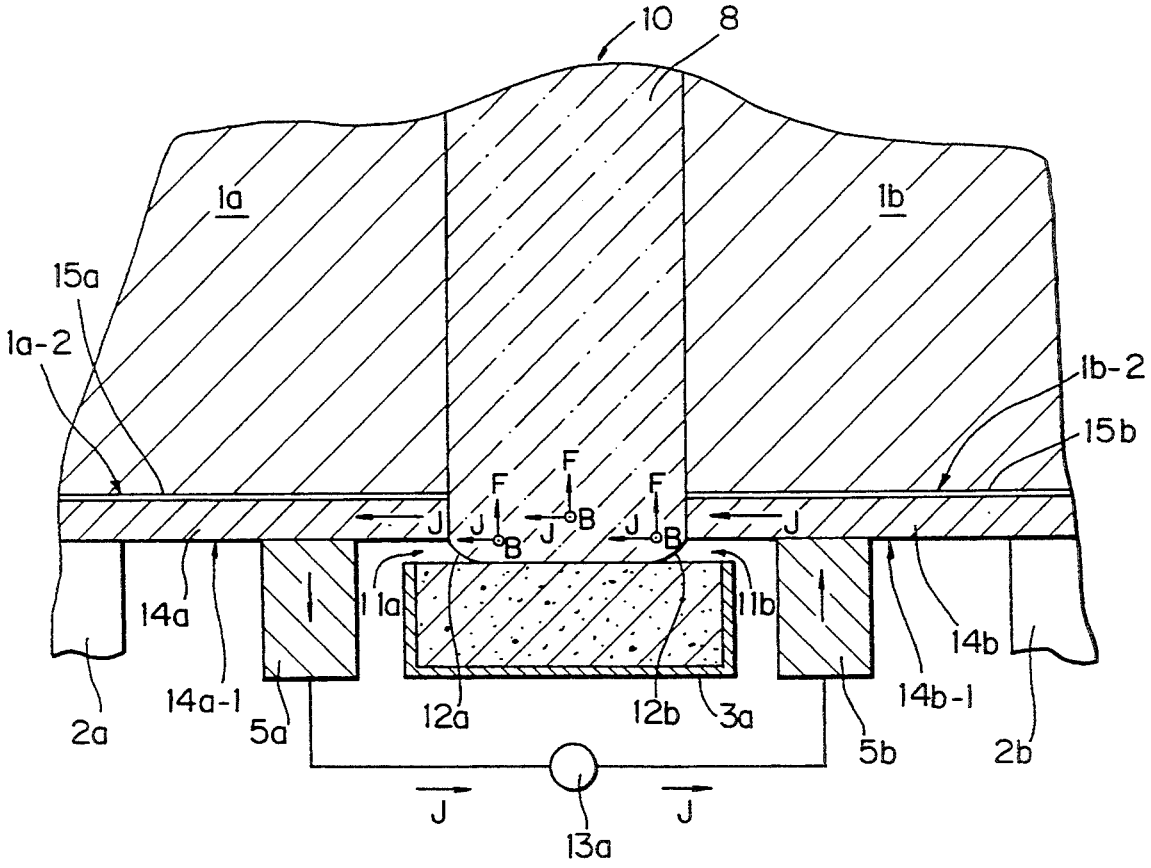
FIG. 4 is a partially enlarged sectional plan view of another embodiment of the present invention.

Another embodiment of the present invention is shown in FIG. 4. Specifically, insulators 15a, 15b, in a thin film form, are adhered to respective end faces 1a-2, 1b-2 of the cooling rolls 1a, 1b shown in FIG. 1, and good electric conductors 14a, 14b in a ring form are provided thereon. Electrodes 5a, 5b are brought into contact with the surface of the good electric conductors 14a, 14b.

Figure 1B:
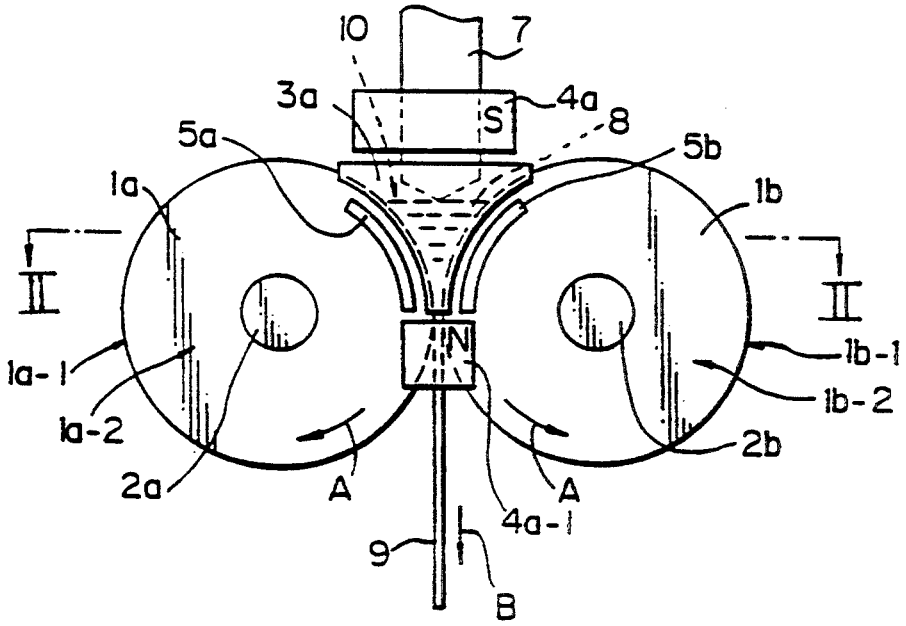

During casting, as with the embodiment shown in FIG. 1, a DC magnetic field directed from the magnetic pole 4a-1 to the magnetic pole 4a is applied to the molten metal in the vicinity of the side gate and DC directed from the electrode 5b to the electrode 5a is applied to the molten metal 8. Since the electrode 5b comes into contact with the good electric conductor 14b being rotated in synchronization with the cooling roll 1b being rotated, DC current J leaving DC power source 13a flows only through the good electric conductor 14b by virtue of the effect of the insulators 15a, 15b, then intensively flows through the end portions of the molten metal including the corner portions 12a, 12b of the molten mental and then returns from the electrode 5a, through the good electric conductor 14a, to the DC power source 13a.

Thus, since the DC current J intensively flows through the end portion of the molten metal, a larger electromagnetic force F than that in the case of the embodiment shown in FIG. 1 acts on the corner portions 12a, 12b of the molten metal by virtue of the function of the DC magnetic field.

Figure 5:
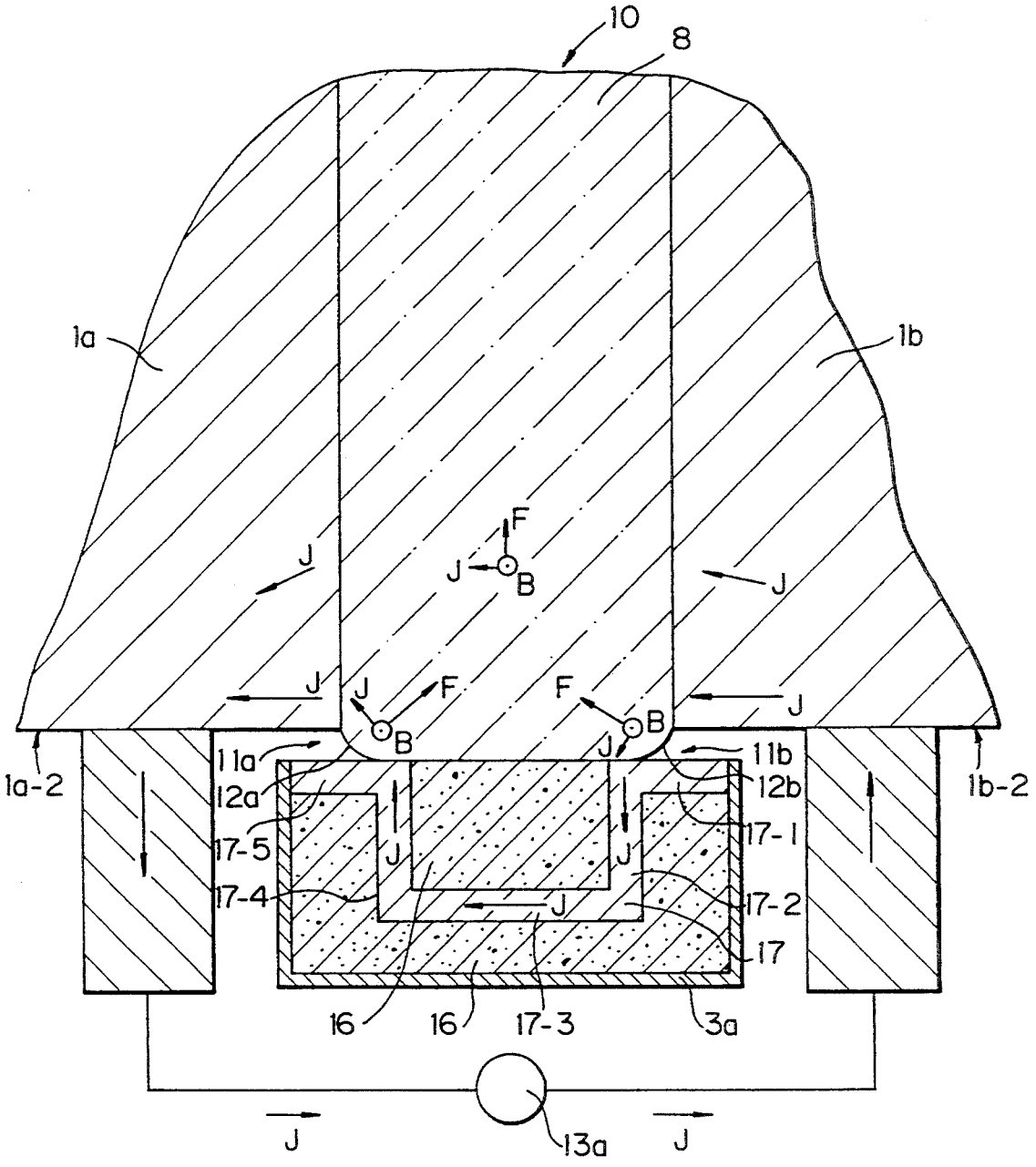
FIG. 5 is a partially enlarged sectional plan view of a further embodiment of the present invention.

In this embodiment, although the degree of concentration of current flowing through the molten metal in the vicinity of the side gate is lower than that attained in an embodiment shown in FIG. 5, this embodiment is effective for preventing the occurrence of cast fins and leakage of the molten metal.

A further embodiment of the present invention will now be described with reference to FIG. 5.

In the apparatus shown in FIG. 5, a good electric conductor 17 is embedded in side gates weirs 3a, 3b (side weir 3b not shown) of the apparatus shown in FIG. 1. In the embodiment shown in this drawing, in a limited region of the side gates facing gaps 11a, 11b and reaching a portion where one end of each corner portion of the molten metal comes into contact with the side gate in a region of the side gate corresponding to a region from the vicinity of the meniscus portion of the pouring basin portion to the vicinity of the kissing point, good electric conductors 17-1, 17-5 are linked with each other at bending portions 17-2, 17-3, 17-4. When use is made of such side gates and a vertical DC magnetic field is applied to the molten metal in the vicinity of the side gates in the same manner as that of the embodiment shown in FIG. 1 and DC current J is fed from the electrode 5b to the electrode 5a through the DC power source 13a, since the electrical resistance is low due to a very small distance between the end face of the cooling roll and the good electric conductor, a major portion of the current flows into the end portion of the cooling roll, so that this large amount of current intensively flows into the corner portions 12a, 12b of the molten metal. As a result, a larger electromagnetic force F than that for the above-described embodiment occurs in the above-described corner portions by virtue of the function of the magnetic pole B. Since the electromagnetic force F is directed to the center portion of the molten metal, it can hold the corner portions 12a, 12b of the molten metal in a more effective manner.

It is a matter of course that this embodiment may be combined with the embodiment shown in FIG. 4, and this combination can provide a larger electromagnetic force.

The good electric conductor integrated into the side gate preferably has a higher electrical conductivity than the molten metal. When the melting point of the good electric conductor is lower than the pouring temperature, it is preferred to internally cool the good electric conductor within the side gate for the purpose of preventing the dissolution. For example, when the molten metal is stainless steel, carbon steel or the like, molybdenum or copper may be used as the good electric conductor within the side gate. When use is made of copper, internal water cooling is preferred.

In order to maintain the magnetic field intensity within the molten metal at a large value, non-magnetic materials (such as refractories) and paramagnetic materials (such as austenitic stainless steel, copper and molybdenum) are preferred as the material for constituting the side gate.

Variable strip width casting wherein the present invention can be most effectively practiced will now be described.

Figure 6A:
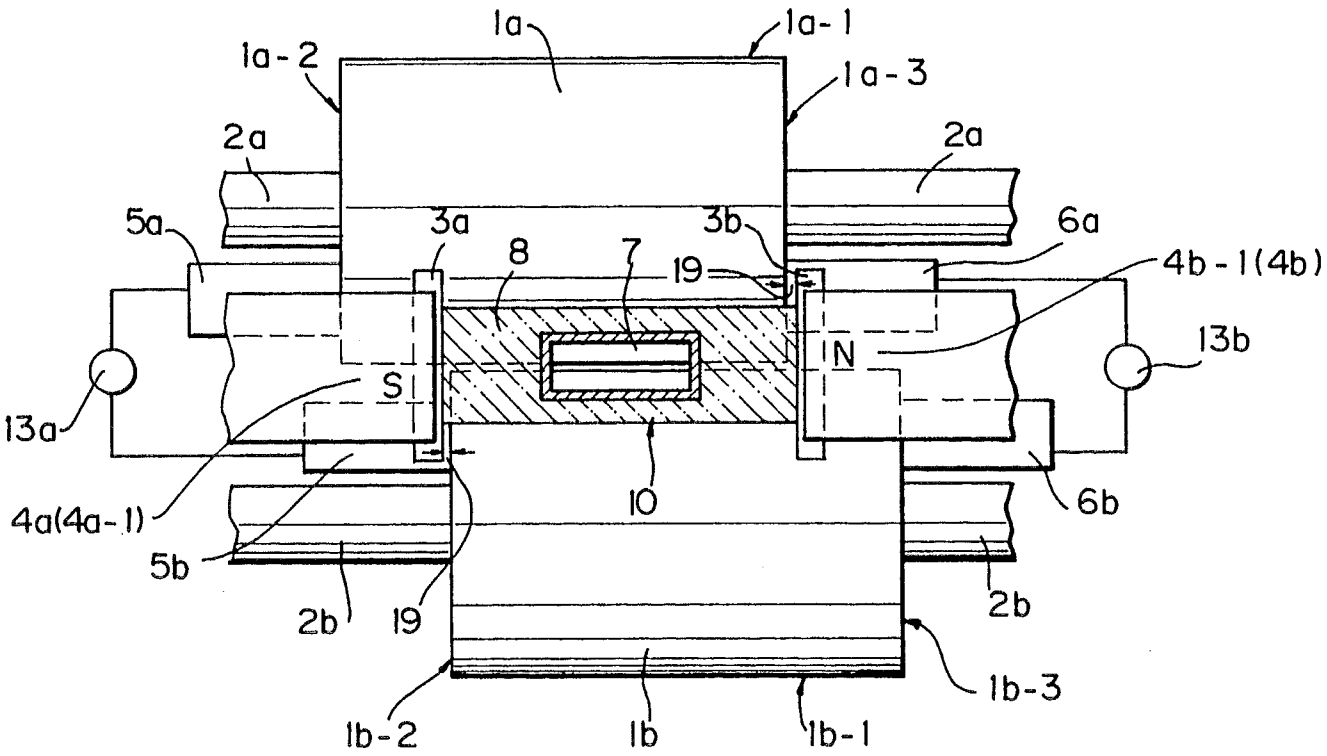
Figure 6B:
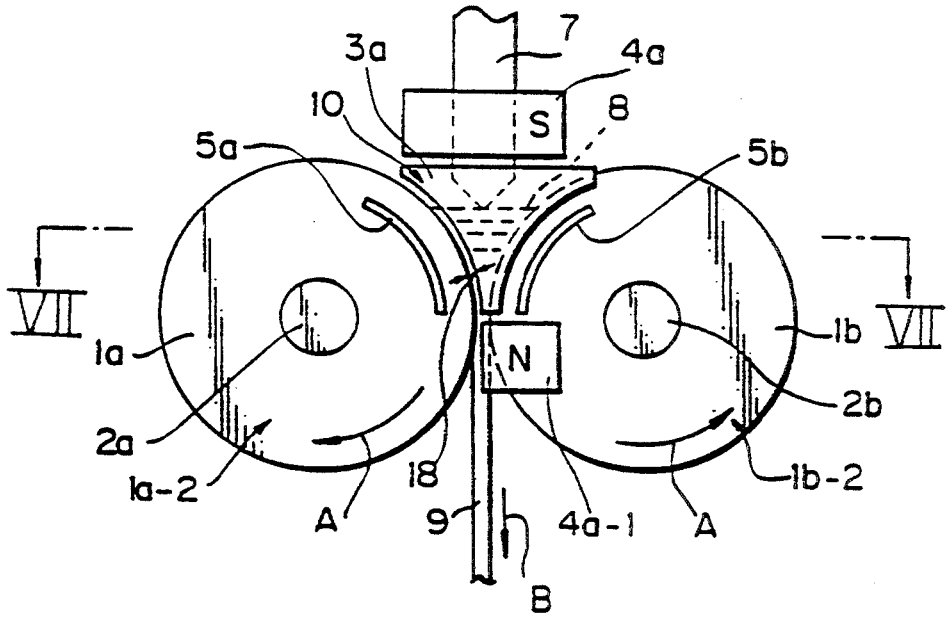

In FIGS. 6(A) and 6(B), cooling rolls are provided at positions relatively shifted in the direction of shafts 2a, 2b, and a side gate 3a is provided so as not to contact with the circumferential surface 1a-1 of a cooling roll 1a or the end face 1b-2 of a cooling roll 1b; also, the side gate 3b is provided so as not to contact the circumferential surface 1b-1 of the cooling roll 1b or the end face 1a-3 of the cooling roll 1a, thereby a pouring basin portion 10 is formed. A south pole 4a as a magnetic pole for applying a DC magnetic field is provided above the side gate 3a, and a north pole 4a-1 as a magnetic pole for applying a DC magnetic field is provided below the side gate 3a. On the other hand, a north pole 4b-1 as a magnetic pole for applying a DC magnetic field is provided above the side gate 3b, and a south pole 4b as a magnetic pole for applying a DC magnetic field is provided below the side gate 3b.

Electrodes 5a, 5b for applying DC are provided in contact with the end faces 1a-2, 1b-2 of the cooling rolls 1a, 1b, and electrodes 6a, 6b are provided in contact with the end faces 1a-3, 1b-3 of the cooling rolls 1a, 1b.

Numeral 7 designates a pouring nozzle, and numerals 13a and 13b each designate a DC power source.

In the above-described apparatus, when a thin sheet is produced, at the outset, a DC magnetic field is applied from the north pole 4a-1 as the magnetic pole to the south pole 4a on the side of the end faces 1a-2, 1b-2 of the cooling rolls. At the same time, a DC magnetic field is applied from the north pole 4b-1 to the south pole 4b on the side of the opposite end faces 1a-3, 1b-3 of the cooling rolls. Further, DC is fed across the cooling rolls 1a, 1b through the side gates 3a, 3b from the electrode 5b to the electrode 5a and from the electrode 6b to the electrode 6a.

Figure 7:
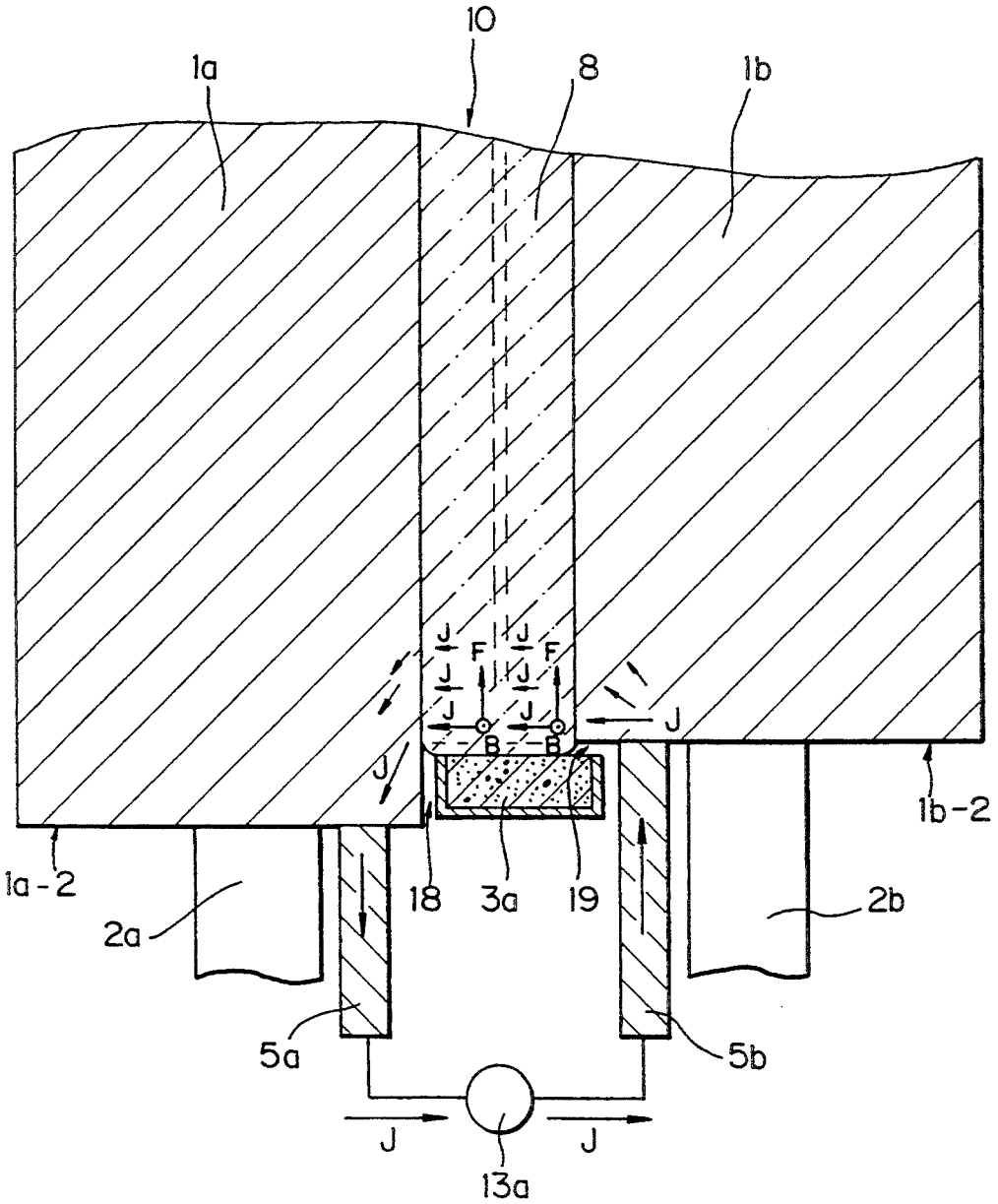
FIG. 7 is a cross-sectional view taken on line VII—VII of FIG. 6(B)

In this state, molten metal 8 is poured into the pouring basin portion 10 through a pouring nozzle 7. Electromagnetic forces within the molten metal, in the vicinity of the side gates, are generated by virtue of the function of the magnetic field generated by the feeding of a current and the function of the current. This is shown in detail in FIG. 7. FIG. 7 is a partial view taken on line VII—VII of FIG. 6(B) and schematically shows the state of DC current J, DC magnetic field B and electromagnetic force F in the vicinity of the surface of the cooling rolls and the side gates.

Specifically, the current J flows from the DC power source 13a through the electrode 5b and the end face 1b-2 of the cooling roll into the cooling roll 1b, flows through the molten metal 8 in the vicinity of the side gate into the cooling roll 1a, and then returns to the DC power source 13a through the end face 1a-2 of the cooling roll and the electrode 5a. The application of a DC magnetic field B causes the magnetic line of force to flow in an upward direction from the paper surface of the drawing (i.e. out of the paper), and a combination of the above-described current with the Fleming's left-hand rule gives rise to the generation of an electromagnetic force F directed to the center portion of the molten metal. In the above-described construction, since DC current flows into the cooling roll 1b, a major part of the current flows in the vicinity of the end face 1b-2 of the cooling roll, so that a large amount of current flows into the molten metal in the vicinity of the side gate to generate a large electromagnetic force F which directs the flow of the molten metal to the center portion of the molten metal. This large electromagnetic force effectively prevents the molten metal from penetrating into the gap 18 between the side gate and the circumferential surface of the cooling roll or the gap 19 between the side gate and the end face of the cooling roll.

Figure 8:
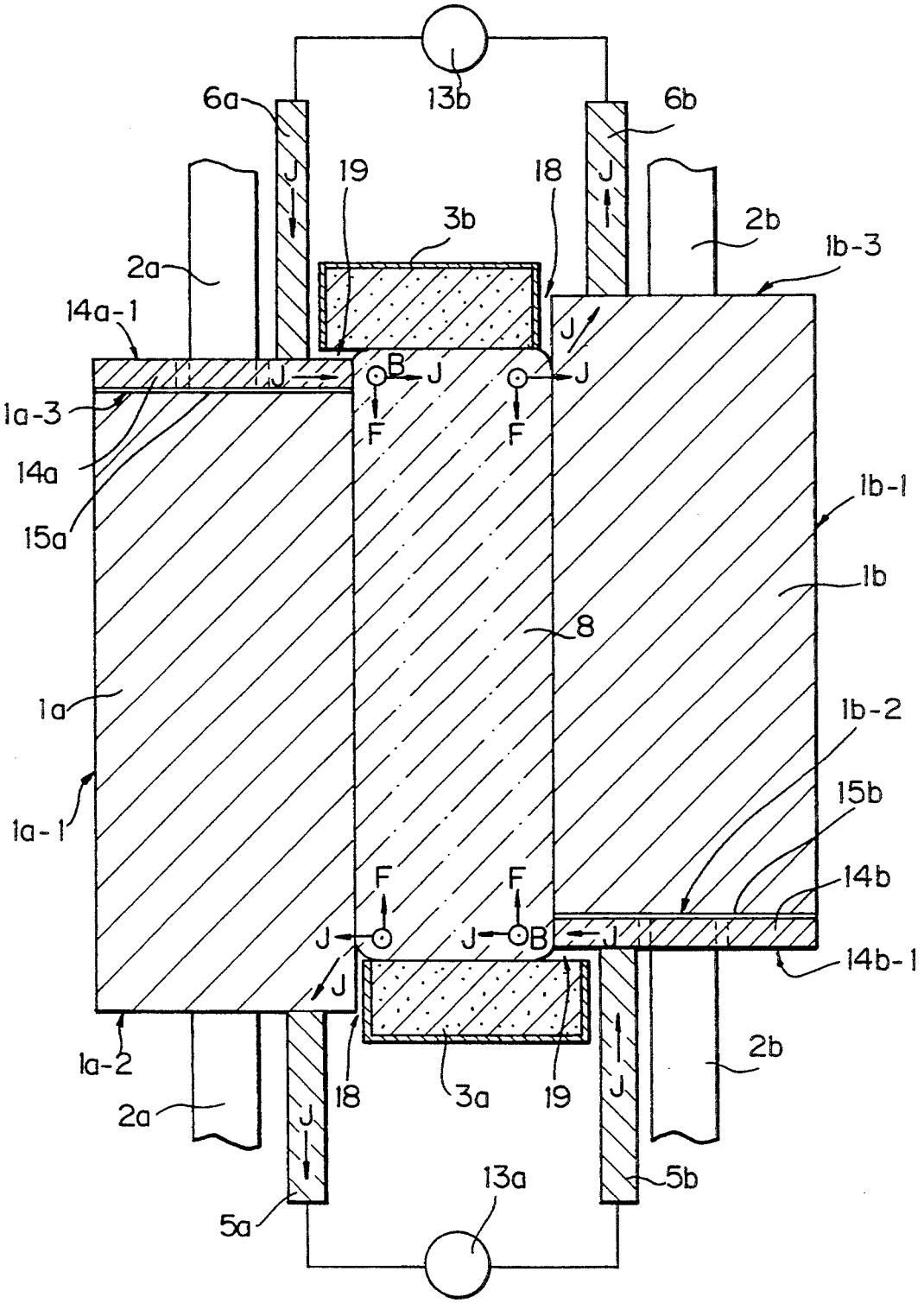
FIG. 8 is a sectional plan view of a further embodiment of the present invention.

FIG. 8 shows an embodiment that enables electromagnetic force to be more intensively generated in the molten metal, in the vicinity of the side gate, than the above-described embodiments. In this embodiment, insulators 15a, 15b, in a thin film form, are adhered to respective end faces 1a-3, 1b-2 of cooling rolls 1a, 1b, and good electric conductors 14a, 14b, in a ring form, are provided on the insulators. Electrodes 5a, 5b, 6a, 6b are provided in contact with the end faces 1a-2, 1b-3 of the cooling rolls 1a, 1b and the surfaces of the good electric conductors 14a-1, 14b-1. DC current J is directed from the electrode 5b to the electrode 5a and from the electrode 6a to the electrode 6b, fed by DC power sources 13a, 13b. The contact of the electrodes 5b, 6a with the good electric conductors 14b, 14a caused the DC current J to flow into the good electric conductors 14b, 14a and prevents the DC current J from flowing into the body of the cooling rolls by virtue of the function of the insulators 15b, 15a and causes the current to flow into the end portion of the molten metal, so that the current flows into the end portion of the molten metal in the vicinity of the side gates in a greater concentration than in the above-described embodiments.

Against this current, when a vertical DC magnetic field is applied in the vicinity of the side gates, the electromagnetic force F can be intensively generated at the end portion of the molten metal.

Figure 9:
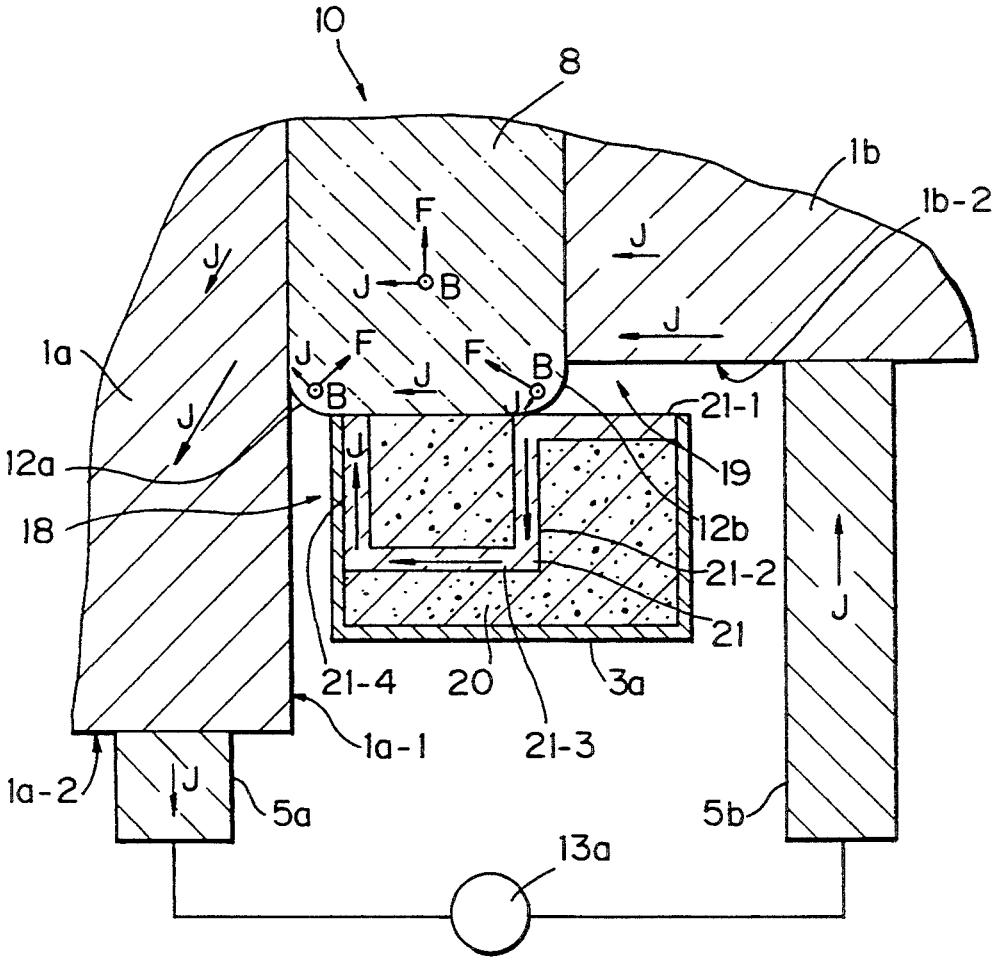
FIG. 9 is a partially enlarged sectional plan view of a further embodiment of the present invention.

FIG. 9 shows a further embodiment of the present invention. In this embodiment, a DC magnetic field is generated at the corner portion of the molten metal in a higher degree of concentration than that in the embodiment shown in FIG. 8. In the embodiment shown in FIG. 9, although the same good electric conductor 21 as that used in the embodiment shown in FIG. 5 is embedded in the side gate 3a in the embodiment shown in FIG. 6, the good electric conductor (good electric conductors 21-1, 21-4 in this embodiment) should be embedded at least in portions where corner portions 12a, 12b come into contact with the surface of the side gates. In this construction, DC current J intensively flows into the corner portions 12a, 12b of the molten metal, so that a larger electromagnetic force F can be generated at the corner portions by virtue of the function of DC magnetic field B.

With respect to the application of the present invention to the casting of a thin sheet in a twin-roll system, the present invention can be applied to the casting of a wide cast strip having a width of 1 m or more. Further, with respect to casting metals, the present invention can be applied to most metals, such as stainless steel, silicon steel, carbon steel and aluminum and copper alloys.

Although embodiments in a twin-roll system where the width of the cast strip is varied or not varied have been described above, it is also possible to apply the present invention to other casting systems. Further, even when preheat or forced vibration is applied to the side gates, the practice of the present invention in addition to the preheat or forced vibration has the effect of enabling casting to be effected more stably.

In each of the above-described embodiments, when a current of 300 A and a DC magnetic field of 0.3 tesla are applied to the vicinity of the side gate, the gap between the side gate and the end face of the cooling roll or the gap between the side face of the side gate and the circumferential surface of the cooling roll is preferably in the range of from 0.1 to 0.4 mm for embodiments shown in FIGS. 1 and 7, in the range of from 0.1 to 0.5 mm for embodiments shown in FIGS. 4 and 8, and in the range of from 0.1 to 1.5 mm for embodiments shown in FIGS. 5 and 9 from the viewpoint of providing cast strips having a well shaped end portion.

EXAMPLES

Example 1. Where cast strip width is not varied:

(1) Experimental conditions:

Experiments on the production of thin sheets of an austenitic stainless steel were effected by using a twin-roll casting machine. The rolls were made of a copper alloy and had a roll diameter of 300 mm and a width of 200 mm. The casting rate was in the range of from 0.15 to 1.5 m/sec, and the arc length of contact of the rolls with a casting metal was about 85 mm (the depth of pool of molten metal in the gap between rolls was about 80 mm). A DC magnetic field of 0.3 tesla was vertically applied to the twin roll, and a DC current of 0 to 500 A was applied. Experiments for the following four cases were effected under the above-described conditions. When use was made of side gates, the gaps 17a, 17b between the side gate and the end face of the roll or the end face of the good electric conductor were varied in the range of from 0 to 2 mm.

Case 1: No side gates were used.

Case 2: In an apparatus as shown in FIG. 1, an alumina side gate was used.

Case 3: In an apparatus as shown in FIG. 4, an alumina adhesive was coated in a thin film form as insulators 15*a*, 15*b*, a 5 mm-thick copper alloy in a ring form was provided as good electric conductors 14*a*, 14*b*, and an alumina side gate was used. The same structure was used also in the ends 1*a*-3, 1*b*-3 of the cooling rolls.

Case 4: In an apparatus shown in FIG. 5, an alumina refractory material was used as the side gate, and copper was used as the good electric conductor. Also the same structure was used also in the end faces 1*a*-3, 1*b*-3 of the cooling rolls.

(2) Experimental results:

In Case 1, the electromagnetic force under the stated experimental conditions could not prevent the molten steel from leaking out from the end portion of the cooling rolls, so that a good cast strip in a thin sheet form could not be provided.

In Case 2, when casting was effected at an applied current of 300 A with the side gate being pressed against the end face of the cooling rolls a hot band often occurred; however, when the gap between the end face of the cooling roll and the side gate was regulated in the range of from about 0.1 to 0.4 mm, no hot bands, cast fins or leakage of the molten metal occurred, so that it was possible to provide thin sheets having a thickness of about 1 to 3 mm and a width of about 200 mm.

In Case 3, when the applied current was increased to some extent, good cast strips having a thickness in the range of from about 1 to 3 mm, depending upon the casting rate, and a width of about 200 mm could be continuously produced. It was found that, in the case of an applied current of 300 A, cast strips having a well shaped end portion could be produced when the gaps between side gate and the end face of the good electric conductor at the end portion of the cooling roll was in the range of from about 0.1 to 0.8 mm.

Figure 10:
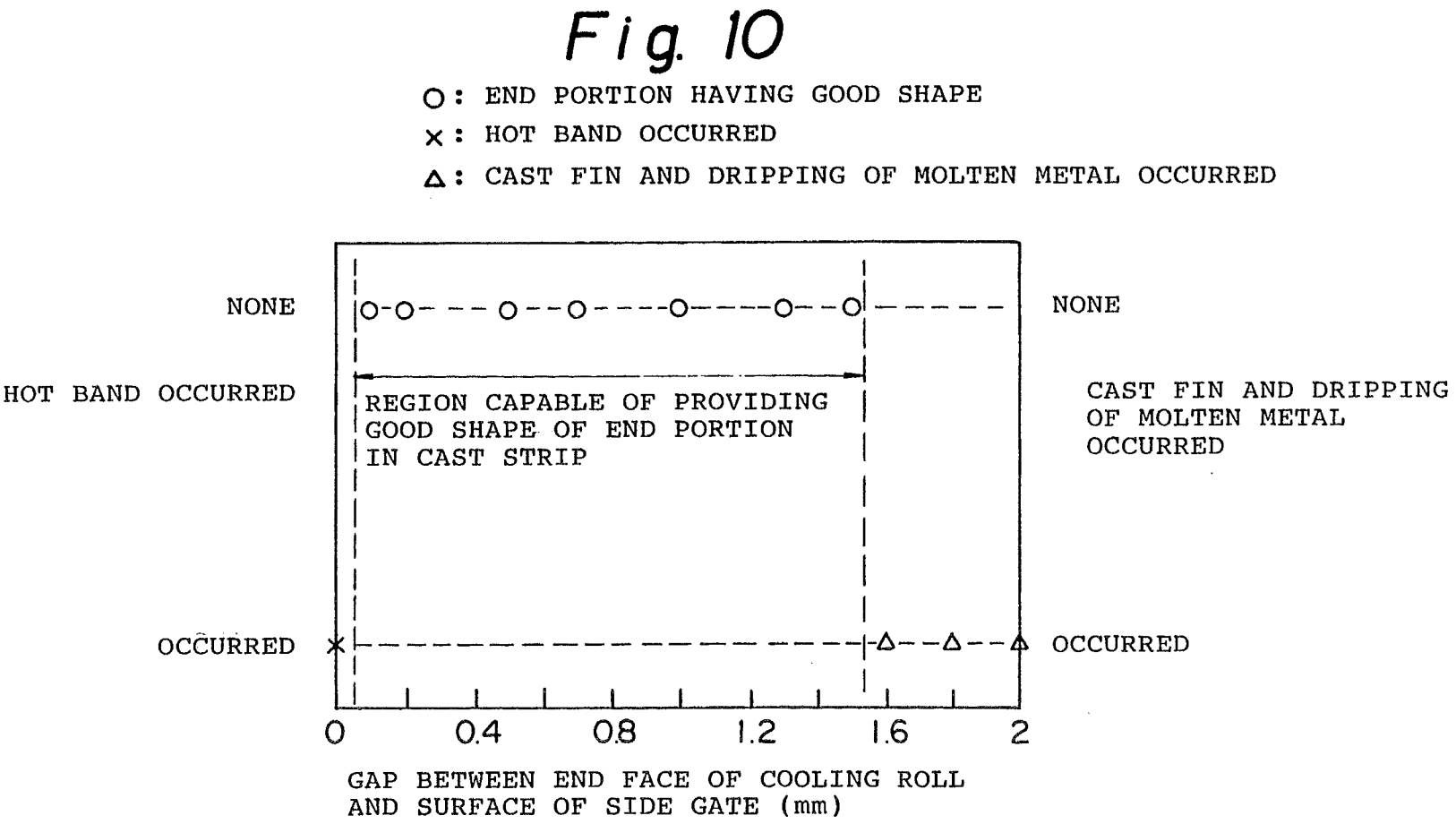
FIG. 10 is a diagram showing the effect of the gap between the end face of the cooling roll and the side weir on the casting of a thin sheet.

In Case 4, the results of an experiment, effected with a DC of 300 A being applied, were as shown in FIG. 10. Neither a cast fin nor leakage of the molten metal occurred when the gap between the side gate and the end portion of the cooling roll was zero (0) (i.e., when casting gap was effected with the side gate being pressed against the end face of the cooling roll), although a hot band often occurred. When the gap was in the range of from about 0.1 to 1.5 mm, no hot bands, cast fins or leakage of molten metal occurred, so that cast strips having a well shaped end portion could be produced. When the gap was about 1.5 mm or more, cast fins and slight leakage of the molten metal occurred. It was found that, when the applied current was increased, neither cast fins nor leakage of the molten metal occurred even under wide gap conditions.

Example 2. Where cast strip width is varied:

(1) Experimental conditions:

Experiments on the production of thin sheets of an austenitic stainless steel were effected by using a twin-roll casting machine. The rolls were made of a copper alloy and had a roll diameter of 300 mm and a width of 200 mm. The casting rate was in the range of from 0.15 to 1.5 m/sec, and the arc length of contact of cooling rolls with a casting metal was about 85 mm (the depth of pool of molten metal in the gap between rolls was about 80 mm). A DC magnetic field of 0.3 tesla was vertically applied to the two cooling rolls, and a DC current of 0 to 500 A was applied. Experiments for the following three cases were effected under the above-described conditions. In this instance, one of the cooling rolls was horizontally shifted in the axial direction of the roll so that the width of the cast strip became 100 mm or 150 mm. The gap (numeral 18 in FIGS. 7 to 9) between the side face of the side gate and the circumferential direction of the cooling roll was 0.2 mm, and the gap (numeral 19 in FIGS. 7 to 9) between the side gate and the end face of the cooling roll or the surface of the good electric conductor was varied in the range of from 0 to 2 mm.

Case 5: In an apparatus as shown in FIG. 7, an alumina side gate was used.

Case 6: In an apparatus as shown in FIG. 8, the same insulator and good electric conductor as in Case 3 were used and an alumina side gate was used.

Case 7: In an apparatus as shown in FIG. 9, the same side gate and good electric conductor as in Case 4 were used.

(2) Experimental results:

In Case 5, as with Case 2, when casting was effected at an applied current of 300 A with the side gate being pressed against the end face of the cooling roll a hot band often occurred; however, when the gap between the end face of the cooling roll and the side gate was regulated in the range of from about 0.1 to 0.4 mm, no hot bands, cast fins or leakage of the molten metal occurred, so that it was possible to provide thin sheets having a thickness of about 1 to 3 mm and a width of about 100 mm or 150 mm and the width of the cast strip could be varied.

In Case 6, when the applied current was increased to some extent, good cast strips having a thickness in the range of from about 1 to 3 mm, depending upon the casting rate, and a width of about 100 mm or 200 mm could be continuously produced and the width of the cast strip could be varied. In the case of an applied current of 300 A, cast strips having a well shaped end portion could be produced when the gaps between the side gate and the surface of the good electric conductor at the end portion of the cooling roll was in the range of from about 0.1 to 0.5 mm.

In Case 7, when casting was effected with the side gate being pressed against the end face of the cooling roll, neither cast fins nor leakage of the molten metal occurred, although a hot band often occurred. When the gap between the end face of the cooling roll and the side gate was in the range of from about 0.1 to 1.5 mm, no hot bands, cast fins or leakage of the molten metal occurred, so that cast strips having a well shaped end portion could be produced, and, further, the width of the cast strip could be varied from 100 mm to 150 mm.

INDUSTRIAL USE

As is apparent from the foregoing detailed description, in the present invention, since the corner portion of a molten metal present in the gap between side gates and cooling rolls can be sufficiently held during continuous casting, not only can the occurrence of leakage of the molten metal be prevented but also the formation of cast fins can be prevented without effecting preheating or vibration of side gates. Further, since there is no need to strongly press the side gates against the end face of cooling rolls, no grinding abrasion occurs in the side gates, so that thin sheets having a good shape can be stably cast for a long period of time. The above renders the present invention very useful, particularly when casting is effected with a variable cast strip width.

We claim:

1. A process for producing a thin sheet by continuous casting in a twin-roll system, comprising:

(a) providing a pair of rotatable cooling rolls having respective shafts parallel to each other;

(b) providing a pair of side gates respectively disposed so as to confront end faces of the cooling rolls, thereby forming a pouring basin for a molten metal, wherein a first gap is provided between a first one of said side gates and respective confronting end faces of said cooling rolls, and a second gap is provided between a second one of said side gates and respective confronting end faces of said cooling rolls;

(c) supplying molten metal to said pouring basin;

(d) applying a DC magnetic field to the molten metal within the pouring basin portion in the vicinity of the side gates in a predetermined direction and, at the same time, providing an electrode in sliding contact with the end faces of said cooling rolls to allow direct current (DC) to flow into the molten metal in the vicinity of the side gates, thereby causing electromagnetic force to be generated in the molten metal in the vicinity of the side gates by said DC magnetic field and said direct current; and (e) solidifying said molten metal with said cooling rolls to continuously cast a thin sheet of metal;

whereby the molten metal is prevented from leaking out from said twin roll system in the vicinity of a corner portion of the molten metal by taking advantage of the electromagnetic force.

2. The process for producing a thin sheet according to claim 1, wherein said DC magnetic field is applied to each side gate in such a manner that a direction of the magnetic field applied to said first one of the side gates is opposite to a direction of the magnetic field applied to said second one of a said side gates, and said DC is applied to the cooling rolls in such a manner that the resultant magnetic force is directed to a center portion of the molten metal in said pouring basin.

3. The process for producing a thin sheet according to claim 1, wherein said direct current is applied through an electrical conductor provided on the end face of each cooling roll.

4. The process for producing a thin sheet according to claim 1, wherein said direct current is applied through an electrical conductor provided on each side gate.

5. A process for producing a thin sheet by continuous casting in a twin-roll system, comprising:

(a) disposing a pair of rotatable cooling rolls having respective shafts parallel to each other with said cooling rolls being shifted with respect to each other along an axial direction of the shafts;

(b) providing a first side gate at a position facing the end face of a first one of the cooling rolls and a circumferential surface of a second one of the cooling rolls, and providing a second side gate at a position facing the end face of the second one of the cooling rolls and a circumferential surface of the first one of the cooling rolls in such a manner that the side gates confront each other, thereby forming a pouring basin portion for molten metal, wherein gaps are provided between the end faces of the cooling rolls and the confronting side gates and between the circumferential surfaces of said cooling rolls and the side gates;

(c) supplying molten metal to said pouring basin;

(d) applying a DC magnetic field to the molten metal within the pouring basin portion in the vicinity of the side gates in a predetermined direction and, at the same time, providing an electrode in sliding contact with the end faces of said cooling rolls to allow direct current (DC) to flow into the molten metal in the vicinity of the side gates, thereby causing electromagnetic force to be generated in the molten metal in the vicinity of the side gates by said DC magnetic field and said direct current; and (e) rapidly solidifying said molten metal with said cooling rolls to continuously cast a thin sheet of metal;

whereby the molten metal is prevented from leaking out from said twin-roll system in the vicinity of a corner portion of the molten metal by taking advantage of the electromagnetic force.

6. The process for producing a thin sheet according to claim 5, wherein said DC magnetic field is applied to each side gate in such a manner that a direction of the magnetic field applied to said first one of the side gates is opposite of the magnetic field applied to said second one of the side gates, and said direct current is applied to the cooling rolls in such a manner that the resultant magnetic force is directed to a center portion of the molten metal in said pouring basin.

7. The process for producing a thin sheet according to claim 5, wherein said direct current is applied through an electrical conductor provided on the end face of each cooling roll.

8. The process for producing a thin sheet according to claim 5, wherein said direct current is applied through an electrical conductor provided on each side gate.

9. An apparatus for producing a thin sheet by continuous casting in a twin-roll system, comprising a pair of rotatable cooling rolls having respective shafts parallel to each other and a pair of side gates respectively provided so as to face end faces of the cooling rolls to form a pouring basin portion for a molten metal, wherein a gap is provided between end faces of said cooling rolls and said side gates in their respective faces confronting each other, a magnetic pole for applying a DC magnetic field is provided above and below said each side gate, and an electrode for applying direct current is provided on said each end face of said cooling rolls.

10. The apparatus for producing a thin sheet according to claim 9, wherein an electrical conductor is provided on an insulator which is covered on the end face of each cooling roll.

11. The apparatus for producing a thin sheet according to claim 9, wherein an electrical conductor is provided at least on said side gates in their portion facing an edge portion in said end portion of said cooling rolls.

12. An apparatus for producing a thin sheet by continuous casting in a twin-roll system, comprising:

a pair of rotatable cooling rolls having respective shafts parallel to each other, said rotatable cooling rolls being shifted with respect to each other along an axial direction of the shafts;

side gates provided at positions wherein faces of said side gates confront the end faces of the cooling rolls and side faces of said side gates face circumferential surfaces of the cooling rolls, thereby forming a pouring basin portion for a molten metal, wherein gaps are provided (i) between the end faces of the cooling rolls and the faces of the side gates confronting each other and (ii) between circumferential surfaces of said cooling rolls and side faces of said side gates;

magnetic poles, for applying a DC magnetic field, disposed above and below each of said side a gates; and electrodes for applying direct current disposed on each of said end faces of said cooling rolls.

13. The apparatus for producing a thin sheet according to claim 12, wherein an insulator is adhered to each of said end faces of said cooling rolls and an electrical conductor is provided on each each of said insulators.

14. The apparatus for producing a thin sheet according to claim 12, wherein an electric conductor is provided at least on said side gates at portions thereof facing an edge portion of the end faces of said cooling rolls and at portions of said side gates in proximity to the gap between the circumferential surface of said cooling rolls and the side face of said side gates.

15. A process for producing a sheet from molten metal, said process comprising:

(a) providing a pair of rotatable cooling rolls in parallel with each other, each of said cooling rolls having first and second end faces;

(b) providing a first side gate adjacent said first end face of one of said cooling rolls such that a first gap is formed therebetween, and providing a second side gate adjacent said second end face of another one of said cooling rolls such that a second gap is formed therebetween, wherein said side gates and cooling rolls serve to form a pouring basin;

(c) providing molten metal to said pouring basin;

(d) applying a DC magnetic field to the molten metal within said pouring basin in the vicinity of said side gates;

(e) simultaneously with step (d), providing an electrode in sliding contact with said end faces of said cooling rolls to supply direct current to said molten metal in the vicinity of said side gates; and (f) cooling said molten metal by said cooling rolls so as to form a sheet.

16. An apparatus for producing a sheet from molten metal, said apparatus comprising:

a pair of rotatable cooling rolls disposed in parallel with each other, each of said cooling rolls having first and second end faces;

a first side gate disposed adjacent said first end face of one of said cooling rolls such that a first gap is formed therebetween, and a second side gate disposed adjacent said second end face of another one of said cooling rolls such that a second gap is formed therebetween, wherein said side gates and cooling rolls serve to form a pouring basin for receiving molten metal;

electrodes connected to individual ones of said end faces of said cooling rolls for supplying direct current to said rolls;

a first magnetic field generator disposed adjacent said first side gate; and a second field generator disposed adjacent said second side gate.

* * * * *

UNITED STATES PATENT AND TRADEMARK OFFICE

CERTIFICATE OF CORRECTION

PATENT NO. : 5,439,046

DATED : August 8, 1995

INVENTOR(S) : Miyazawa Kenichi et al

It is certified that error appears in the above-identified patent and that said Letters Patent is hereby corrected as shown below:

Column 1, line 66, before "circumferential" insert --the--
change "cooing" to --cooling--
Column 2, line 14, after "Also" insert --,--
Column 2, line 31, after "technique" insert --,--
Column 3, line 1, before "INVENTION" insert --THE--
Column 3, line 10, change "allows" to --allow--
Column 3, line 37, change "slide" to --sliding--
Column 3, line 65, change "the end" to --an end--
Column 4, line 50, change " shows" to --show--
Column 5, line 56, before "preventing" insert --of--
Column 7, line 38, change "mental" to --metal--
Column 8, line 44, delete "with"
Column 9, line 29, before "Fleming's" delete "the"
Column 9, line 60, change "caused" to --causes--
Column 11, line 14, after "Also" insert --,--; delete "also"
Column 15, line 8, change "side a gates" to --side gates--
Column 15, line 15, delete "each" (second occurrence)

Signed and Sealed this

Twenty-third Day of January, 1996

*Attest:*

Bruce Lehman

BRUCE LEHMAN

*Attesting Officer*

*Commissioner of Patents and Trademarks*